United States Patent [19]

Rickard

[11] 4,116,107

[45] Sep. 26, 1978

[54] STRINGED INSTRUMENT MUTE MECHANISM

[75] Inventor: James H. Rickard, Harwinton, Conn.

[73] Assignee: Ovation Instruments, Inc., New Hartford, Conn.

[21] Appl. No.: 760,735

[22] Filed: Jan. 19, 1977

[51] Int. Cl.[2] ..... G10D 3/04

[52] U.S. Cl. ..... 84/267; 84/1.16; 84/299

[58] Field of Search ..... 84/1.16, 267, 273, 290, 84/298, 299, 307, 310, 311

[56] References Cited

U.S. PATENT DOCUMENTS

| | | | |
|---|---|---|---|
| 2,222,959 | 11/1940 | Stathopoulo | 84/267 |
| 3,015,247 | 1/1962 | Allers | 84/267 X |
| 3,456,063 | 7/1969 | Teranishi et al. | 84/1.16 |

*Primary Examiner*—Lawrence R. Franklin

*Attorney, Agent, or Firm*—McCormick, Paulding & Huber

[57] ABSTRACT

A mute mechanism for an electric string bass or other stringed musical instrument is permanently mounted on the body of the instrument and includes a rubber faced mute movable into and out of engagement with the instrument's strings by a manually shiftable slide readily accessible by a performer playing the instrument.

7 Claims, 6 Drawing Figures

STRINGED INSTRUMENT MUTE MECHANISM

BACKGROUND OF THE INVENTION

This invention relates to stringed musical instruments, and deals more particularly with a mute mechanism intended to be permanently attached to such an instrument and readily manually shiftable between active and inactive conditions.

The mechanism of this invention includes a mute having a face, preferably provided by a pad or body of resilient material, pressed against the strings of the instrument when the mute is in its active condition. Such a mute is particularly well adapted for use with electric string basses and it is therefore herein shown and described in such environment. There is, however, no intention to limit the mechanism of this invention to such use, and instead it may be applied to a wide variety of other types of stringed instruments if desired.

SUMMARY OF THE INVENTION

The invention resides in a mute mechanism having a mute with a face adapted to engage the strings of the instrument when in an active position. The mute is supported for rectilinear movement along an axis perpendicular to its string engagement face to move it into and out of contact with the strings. A manually operable actuating member, shiftable between two positions, and a mechanical linkage or other motion transmitting means between the actuating member and the mute move the mute between its string contacting active position and its string non-contacting inactive position in response to movement of said actuating member between its two positions.

The invention further resides in the mute being carried by a base attached, or adapted for attachment to, an instrument body, in the actuating member being a slide slidably carried by the base, in a pair of links each pivotally connected at one end to the slide and pivotally connected at its other end to the mute for moving the mute relative to the base in response to movement of the slide relative to the base, and in the base having a recess for receiving the mute which recess has a cross-sectional shape complementary to that of the mute so that the walls of the recess restrain the mute to rectilinear sliding movement relative to the base.

DETAILED DESCRIPTION OF THE PREFERRED EMBODIMENT

Figure 1:
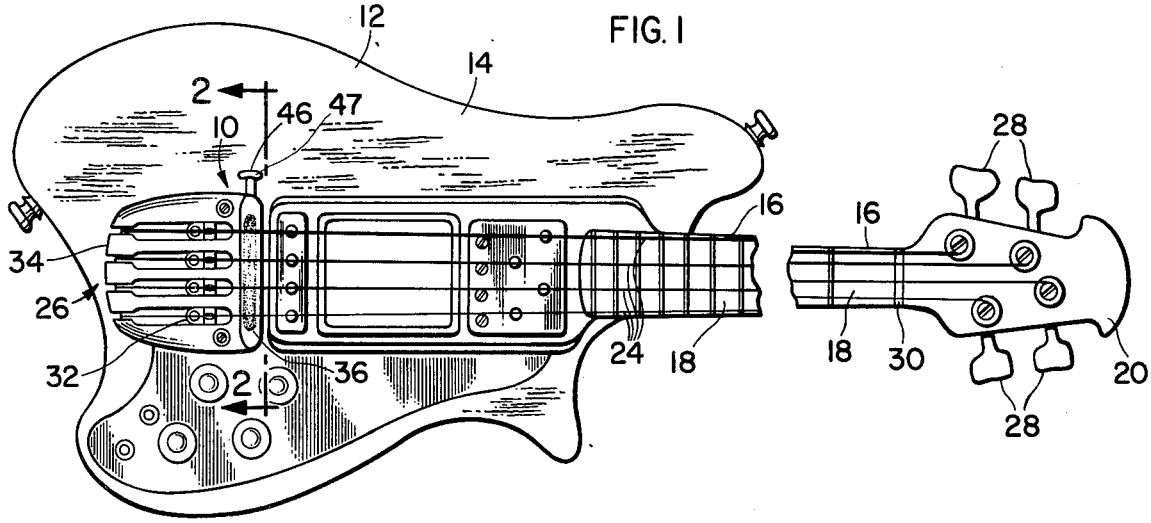
FIG. 1 is a fragmentary plan view of an electric string bass equipped with a mute mechanism embodying this invention.

Referring to the drawing, a mute mechanism 10 embodying the present invention is shown in FIG. 1 in combination with an electric string bass 12. This instrument has a solid wooden body 14 and a neck 16, with attached fret board 18, extending from one end thereof and terminating in a peg head 20. Each of four strings 24, 24 is anchored at one end to a tailpiece means indicated generally at 26 and at its other end to an associated one of four machine heads 28, 28 carried by the peg head 20. In passing from the tailpiece to the machine heads, the strings pass over and are stretched between a bridge near the tailpiece and a nut 30 adjacent the peg head 20. The bridge consists of four separate saddle members 32, 32 adjustably fixed to a base 34, preferably of die cast metal, in turn fixed to the instrument body 14. Each saddle member 32 supports an individual string 24.

In the illustrated case, the three components consisting of the tailpiece 26, the bridge and the mute mechanism 10 are combined with one another to form a single unit, and the base 34 is a part common to all three of these components. This, however, is not necessary to the invention and, if desired, the mute mechanism may be made separate from either or both of the tailpiece and bridge. In particular, in the description which follows, the base 34 provides the base of the mute mechanism but the mute mechanism may alternatively have a base separate from that of the bridge and tailpiece in other situations.

Turning now to FIGS. 2 to 6, the mute mechanism 10 includes a mute 36 comprised of a carrier 38 carrying a pad 40 of resilient material such as sponge rubber. A string engagement face 42 of the pad 40 faces and extends transversely across the four strings 24, 24. The mute 36 is received in a recess 44 of the base 34. This recess has a mouth facing the strings 24, 24 and the cross-sectional shapes of the recess and of the mute, in a plane generally parallel to the common surface defined by the strings, are complementary so that the mute is restrained by the walls of the recess to rectilinear movement toward and away from the strings, that is, to movement along an axis perpendicular to the string engagement face 42.

Figure 2:
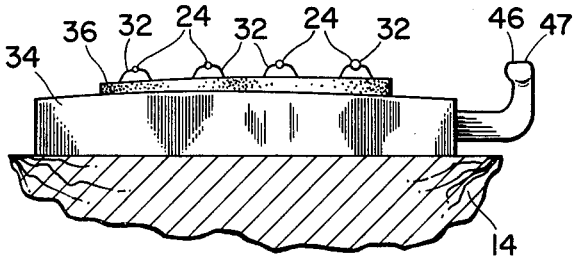
FIG. 2 is an end elevational view of the mute mechanism of FIG. 1 and taken on the line 2—2 of that figure, this figure showing the mute in its lowered or inactive position at which it is free of the strings.
Figure 3:
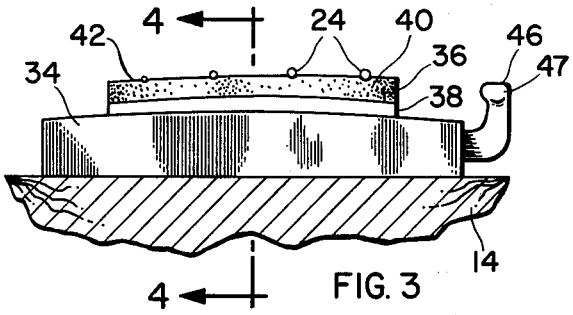
FIG. 3 is a view similar to FIG. 2 but shows the mute in its raised or active position at which it contacts the strings.

The mute 36 is movable relative to the base 34 between an inactive position, such as shown in FIG. 2, at which it is out of contact with the strings and an active position, such as shown in FIG. 3, at which it is held in engagement with the strings with the pad 40 being compressed between the strings and the carrier 38.

Figure 4:
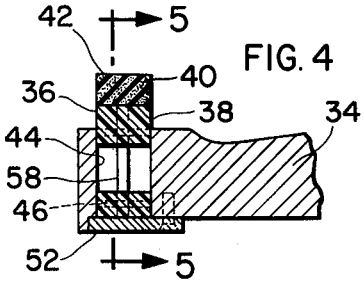
FIG. 4 is a fragmentary sectional view taken on the line 4—4 of FIG. 3.

An actuating means for manually moving the mute between its active and inactive positions includes a manually shiftable actuating member in the form of a slide 46 having a handle portion 47 located on one side of the set of strings 24,24. A slide cavity 48 formed in the base 34, and communicating with the mute receiving recess 44, slidably receives the slide. The walls of the slide cavity 48 confine the slide 46 to rectilinear sliding movement relative to the base along the axis 50 shown in FIG. 6 between the two positions shown in FIGS. 5 and 6. Part of the slide cavity 48 is defined by a removable plate 52 held to the base 34, as by screws, as shown in FIG. 4. The base 34 and slide 46 have coengageable stop surfaces 54 and 56, FIG. 6, which are engageable as shown in FIG. 5 to limit leftward (as seen in the drawing) movement of the slide relative to the base.

The mute 36 is moved between its active and inactive positions in response to movement of the slide 46 between its two end positions by two links 58, 58 each pivotally connected to the slide 46 at one of its ends by a pivot pin 60 and pivotally connected at the other of its ends to the carrier part of the mute by a pivot pin 62.

Figure 6:
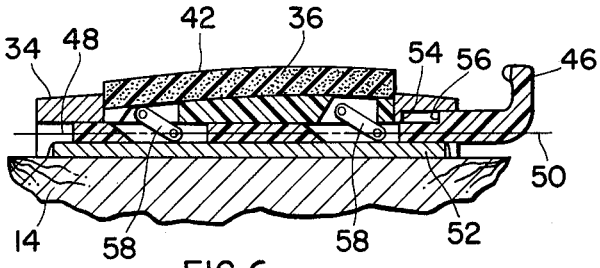
FIG. 6 is a view similar to FIG. 5 but shows the mute in its lowered or inactive position.
Figure 5:
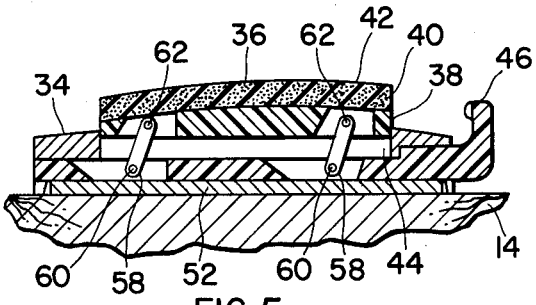
FIG. 5 is a sectional view taken on the line 5—5 of FIG. 4.

It should further be noted from FIGS. 5 and 6 that the relative arrangement of the slide 46, mute 36, and links 58, 58 is such that as the slide is moved to the left to move the mute from its inactive (FIG. 6) position to its active (FIG. 5) position, the pivot pins 62, 62 move over center relative to the pivot pins 60, 60 just shortly prior to the FIG. 5 position being reached. Therefore, the pressure of the strings bearing down on the mute pad 40 will tend to hold the mute and slide in their FIG. 5 positions, that is with the stop surfaces 54 and 56 in engagement with one another, until the slide is manually shifted to the right to lower the mute.

I claim:

1. The combination with a stringed musical instrument having a body and a set of generally parallel strings which are attached to said body and define a common surface containing said strings and a mute mechanism carried by said body, said mute mechanism comprising a base fixed to said body and located on one side of said common surface and extending transversely across said strings, said base having a recess with a mouth facing said strings, said recess being elongated in the direction transverse of said strings and extending transversely across said strings, a mute received in said recess and having a cross-sectional shape complementary to that of said recess so as to be confined by the walls of said recess to rectilinear sliding movement relative to said base toward and away from said strings, said base also having a slide recess elongated in the direction transverse of said strings, an actuating member received in said slide recess and restrained by the walls of said slide recess to sliding movement relative to said base in said direction transverse of said strings, said actuating member having a handle portion located on one side of said strings and being manually slidable relative to said base between first and second positions, and means for moving said mute toward and away from said strings in response to shifting of said actuating member in opposite directions and whereby said mute engages said strings when said actuating member is in said first position relative to said base and is free of said strings when said actuating member is in said second position relative to said base.

2. The combination defined in claim 1 further characterized by said mute including a carrier made of rigid material and a face pad of resilient material carried by said carrier and arranged to be compressed between said strings and said carrier when said mute is in engagement with said strings.

3. A mute mechanism for attachment to the body of a stringed musical instrument, said mechanism comprising a base adapted for attachment to an instrument body, a mute having a string engagement face and carried by said base for rectilinear movement relative thereto, between active and inactive positions, along an axis perpendicular to said string engagement face, an actuating member carried by said base and manually shiftable relative to said base between first and second positions, coengagable stop means between said base and said actuating member limiting movement of said actuating member in one direction relative to said base to said first position and linkage means for moving said mute relative to said base between said active and inactive positions in response to the shifting of said actuating member relative to said base between said first and second positions, said linkage means including at least one link pivotally connected to said actuating member for movement of said link relative to said actuating member about a first pivot axis and pivotally connected to said mute for movement of said link relative to said mute about a second pivot axis, said first and second pivot axes being so arranged that when said actuating member is in said first position said first and second axes are in an overcenter condition so that the pressure of said strings on said mute tends to hold said stop means coengaged and to resist movement of said slide toward its said second position thereby causing said mute to remain engaged with said strings until said actuating member is manually shifted to said second position.

4. A mute mechanism as defined in claim 3 further characterized by said base having a recess with a mouth facing and extending transversely across said strings, said mute being received in said recess, and said recess and said mute having complementary cross-sectional shapes so that said mute is restrained by the walls of said recess to rectilinear sliding movement relative to said base toward and away from said strings.

5. A mute mechanism as defined in claim 4 further characterized by said base including a slide cavity communicating with said recess, and said actuating member being a slide received in said slide cavity and restrained by the walls of said slide cavity to rectilinear sliding movement relative to said base between said first and second positions.

6. The combination with a stringed musical instrument having a body and a set of generally parallel strings which are attached to said body and defined a common surface containing said strings and a mute mechanism carried by said body, said mute mechanism comprising a mute located on one side of said common surface and extending transversely across said strings, an actuating member manually shiftable relative to said body between first and second positions, and means for moving said mute toward and away from said strings in response to shifting of said actuating member in opposite directions and whereby said mute engages said strings when said actuating member is in said first position and is free of said strings when said actuating member is in said second position, said mute mechanism including a base fixed to said body and slidably supporting said mute for movement toward and away from said strings, said base being located on the same side of said common surface as said mute, said base having a recess with a mouth facing and extending transversely across said strings, said mute being received in said recess, said recess and said mute having complementary cross-sectional shapes so that said mute is restrained by the walls of said recess to rectilinear sliding movement relative to said base toward and away from said strings, said base including a slide cavity communicating with said recess, said actuating member being a slide received in said slide cavity and restrained by the walls of said slide cavity to rectilinear sliding movement relative to said base between said first and second positions, and said actuating mechanism being a pair of links each pivotally connected at one end of said slide and pivotally connected at its other end to said mute.

7. A mute mechanism for attachment to the body of a stringed musical instrument, said mechanism comprising a base adapted for attachment to an instrument body, a mute having a string engagement face and carried by said base for rectilinear movement relative thereto, between active and inactive positions, along an axis perpendicular to said string engagement face, an actuating member carried by said base and manually shiftable relative to said base between first and second positions, and means for moving said mute relative to said base between said active and inactive positions in response to the shifting of said actuating member relative to said base between said first and second positions, said base having a recess with a mouth facing and extending transversely across said strings, said mute being received in said recess, said recess and said mute having complementary cross-sectional shapes so that said mute is restrained by the walls of said recess to rectilinear sliding movement relative to said base toward and away from said strings, said base including a slide cavity communicating with said recess, said actuating member being a slide received in said slide cavity and restrained by the walls of said slide cavity to rectilinear sliding movement relative to said base between said first and second positions, and said actuating mechanism being a pair of links each pivotally connected at one end to said slide and pivotally connected at its other end to said mute.

* * * * *